US006572418B2

(12) United States Patent
Takaya et al.

(10) Patent No.: US 6,572,418 B2
(45) Date of Patent: Jun. 3, 2003

(54) TERMINAL DEVICE OF ELECTRIC APPARATUS

(75) Inventors: Kouetsu Takaya, Saitama (JP); Yutaka Nakamura, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/013,958

(22) Filed: Dec. 13, 2001

(65) Prior Publication Data

US 2002/0081914 A1 Jun. 27, 2002

(30) Foreign Application Priority Data

Dec. 22, 2000 (JP) ..... 2000-390396

(51) Int. Cl.[7] ..... H01R 4/36

(52) U.S. Cl. ..... 439/812; 439/810; 439/814; 439/411

(58) Field of Search ..... 439/810, 411; 361/634; 489/812; 24/135 N, 135 R

(56) References Cited

U.S. PATENT DOCUMENTS 2,161,249 A * 6/1939 Dibner ..... 439/812
2,877,443 A * 3/1959 Bonnet et al. ..... 439/812
2,938,191 A * 5/1960 Kobryner et al. ..... 439/812
3,075,164 A * 1/1963 Humpage et al. ..... 439/814
4,213,669 A * 7/1980 Wittes et al. ..... 439/811
5,197,907 A * 3/1993 Hurtgen ..... 439/810
5,206,789 A * 4/1993 Barbry ..... 361/355
5,879,205 A * 3/1999 Egenolf et al. ..... 439/852
5,978,208 A * 11/1999 Holmes et al. ..... 361/634
6,074,121 A * 6/2000 Medeiros et al. ..... 403/362

FOREIGN PATENT DOCUMENTS

JP 7-312235 11/1995
JP 10-199591 7/1998

* cited by examiner

*Primary Examiner*—Tho D. Ta
*Assistant Examiner*—Larisa Tsukerman
(74) *Attorney, Agent, or Firm*—Kanesaka & Takeuchi

(57) ABSTRACT

A terminal device of an electric apparatus having a terminal board of a main circuit includes a hollow member connected to the terminal board of the main circuit of the apparatus. The hollow member is formed of an elongated metal plate having a screw hole, one end with a projection, and the other end with an engaging groove. The elongated metal plate is bent such that the projection and engaging groove are directly joined together to connect the one and the other end. A terminal screw is engaged with the screw hole of the hollow member.

8 Claims, 4 Drawing Sheets

Fig. 1(a)
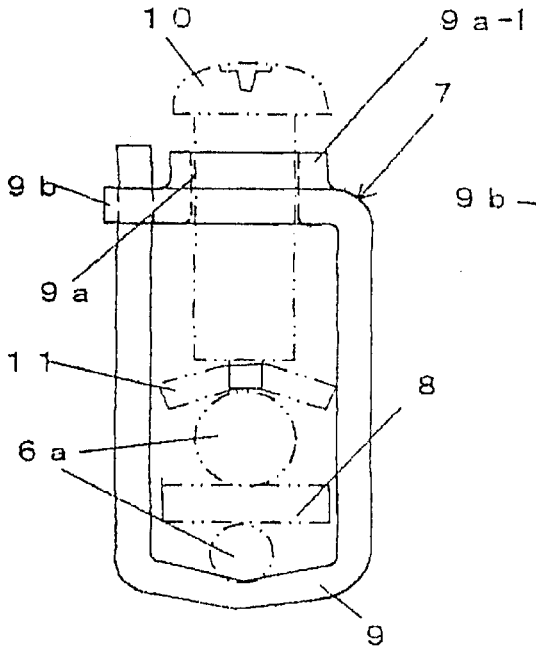
Fig. 1(b)
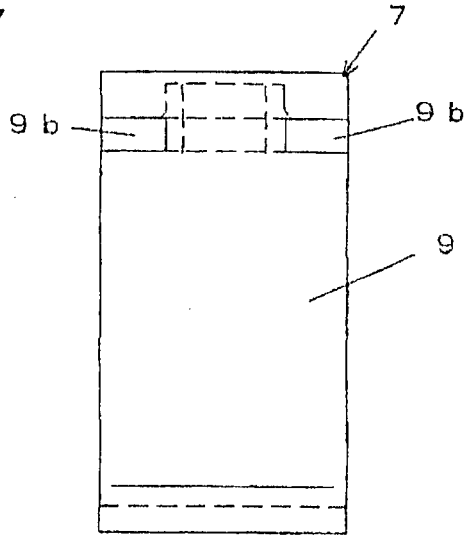
Fig. 2(a)
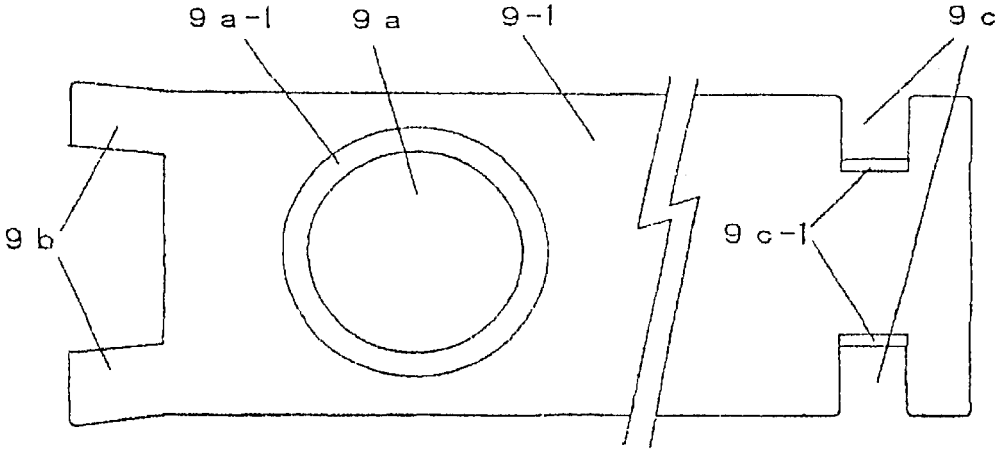
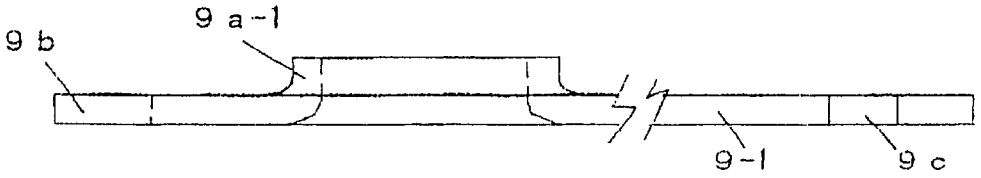
Fig. 2(b)

Fig. 3(a)
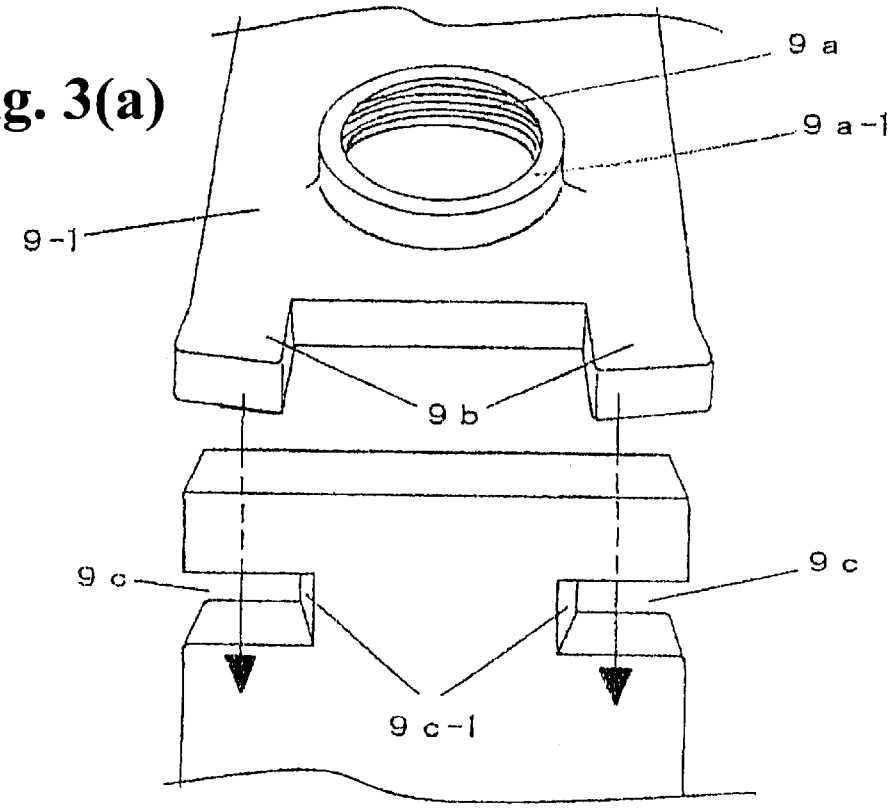
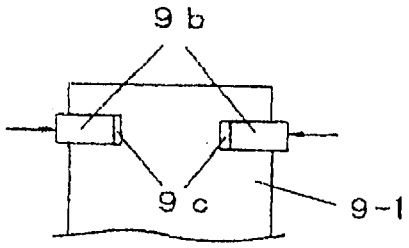
Fig. 3(b)
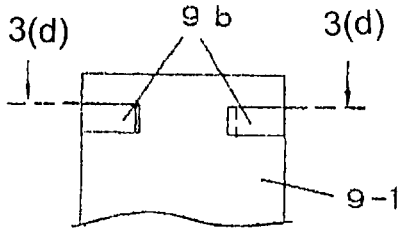
Fig. 3(c)
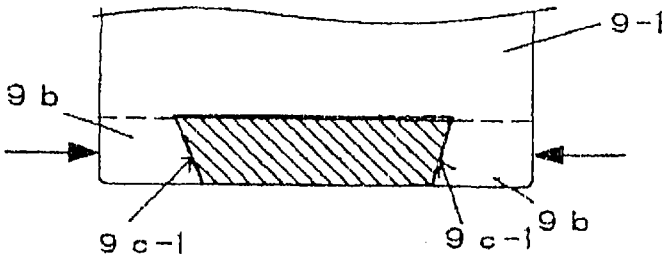
Fig. 3(d)

Fig. 4(a)
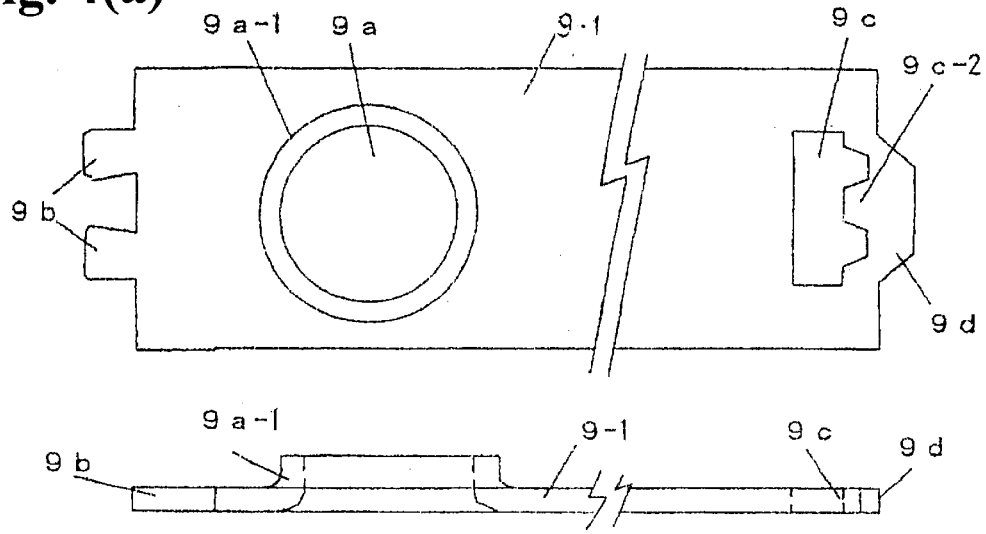
Fig. 4(b)
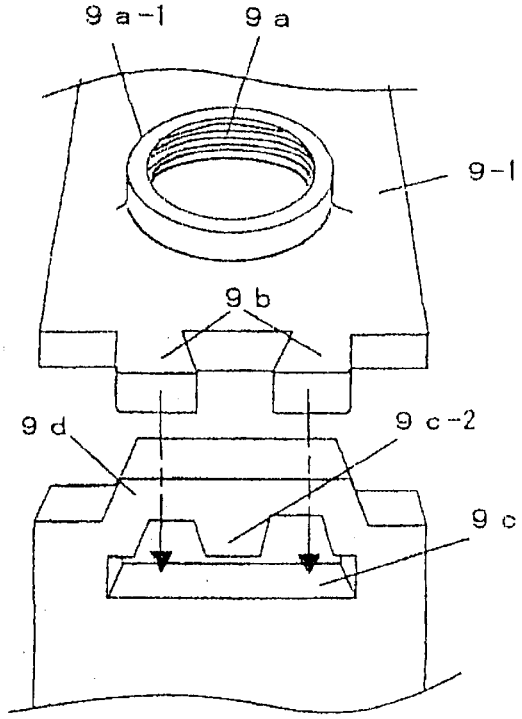
Fig. 4(c)
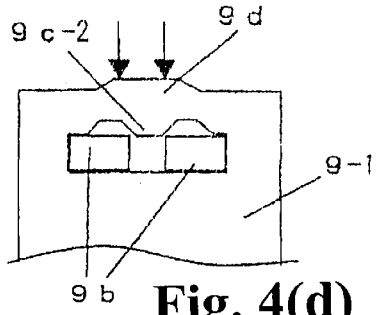
Fig. 4(d)
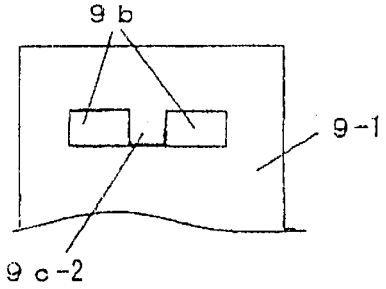
Fig. 4(e)

TERMINAL DEVICE OF ELECTRIC APPARATUS

BACKGROUND OF THE INVENTION AND RELATED ART STATEMENT

The present invention relates to a wiring terminal device, which is connected to a terminal of an electric apparatus such as an electromagnetic contactor and a thermal relay attached to the electromagnetic contactor.

FIGS. 5(*a*) and 5(*b*) illustrate the above-mentioned electromagnetic contactor and thermal relay to which the present invention is applied. In these figures, a body case 3 for the electromagnetic contactor 1 and the thermal relay 2 is a resin-molded case. The body case 3 has wiring terminals 4 of a main circuit and a control circuit. The wiring terminals 4 are extended from the body of the apparatus to terminal portions 3*a* of a main and control circuit. Each terminal portion 3*s* is formed between interphase barriers.

A screw terminal corresponding to an electric wire (insulated coated wire) 6 having a compression terminal 5 is a standard equipment on the wiring terminal 4. If a strand 6*a* of the electric wire 6 is directly wired without using a compression terminal, a terminal device 7 is used as shown in FIGS. 6(*a*) and 6(*b*).

The terminal device 7 is connected to a terminal board 8 of the main circuit, which is extended to the terminal portion 3*a*, and is used to screw the strand 6*a* of the electric wire 6, inserted from the outside, between the terminal board 8 and a washer 11.

The terminal device 7 is comprised of a hollow member 9, a terminal screw 10 engaged on top of the member 9, and the washer 11 joined to the end of the terminal screw 10. As shown in the figures, to screw the strand 6*a* of the electric wire 6 inserted into the terminal portion 3*a* from the front, the strand 6*a* is pressed and screwed between the terminal board 8 and the washer 11 by screwing down the terminal screw 10. It should be noted that reference numeral 12 denotes a terminal cover that covers the terminal portion 3*a* to prevent electrification, an opening for inserting the electric wire 6 is formed in the front surface of the terminal cover 12, and an opening for operating the terminal screw 10 is formed in the upper surface of the terminal cover 12.

On the other hand, if the electric wire 6 is wired by using the terminal device 7, the clamp torque by screwing action is applied to the box 9 and the groove of the box 9 threading the terminal screw 10. Therefore, the member 9 needs to ensure such contour strength and thickness as to prevent deformation, and accordingly, the member 9 as a casting is used for the conventional terminal device 7.

The above-mentioned conventional terminal device 7, however, requires high cost due to a large scale casting equipment, and the conventional terminal device 7 cannot achieve enough accuracy.

It is therefore an object of the present invention to provide a new terminal device whose hollow member can easily be manufactured by using a series of press devices in a machining process by using a flat metal plate in order to reduce the cost and improve the dimensional accuracy.

SUMMARY OF THE INVENTION

To accomplish the above object, the present invention provides in the first aspect a terminal device of an electric apparatus that is connected to a terminal board of a main circuit of an electric apparatus to screw a strand of an electric wire. The terminal device comprises a hollow member connected to the terminal board, a terminal screw engaged on top of the hollow member, and an electric wire pressing washer connected with an end of the terminal screw. The hollow member is constructed by bending an elongated metal plate in a form of a cylinder such that both ends thereof are directly joined together. The elongated metal plate may have a burred terminal screw hole, press-fitted engagement projections formed at one end thereof, and engagement grooves formed at the other end thereof. The engagement projections are fitted into the engagement grooves by fitting together the engagement projections and the engagement grooves in the directions perpendicular to each other in a state in which the metal plate is bent in the form of a cylinder while the terminal screw hole is positioned on top of the member. Preferred forms of the present invention will now be described.

(1) The two press-fitted engagement projections are stamped at both sides of one end of the metal plate, and the engagement grooves corresponding to the engagement projections are notched as U-shaped grooves at both sides of the other end of the metal plate (the second aspect).

(2) The two press-fitted engagement projections are formed in parallel at the center of an end of the metal plate, and the engagement grooves corresponding to the engagement projections are stamped as window holes in a surface of the other end of the metal plate (the third aspect).

(3) According to the above-mentioned paragraphs (1) and (2), the engagement projections and the engagement grooves are joined together and press-fitted in a state in which the engagement projections are fitted into the engagement grooves (the fourth aspect).

With the above described arrangement, the sequence of machining steps from the supply to assembly of the flat strip plate as material, i.e. a machining process comprising stamping, stamping and press-fitting, can be carried out by means of a series of press devices to thus manufacture the hollow member of the terminal device. Moreover, since the engagement projections and the engagement grooves formed at both ends of the elongated metal plate are fitted together perpendicularly to one another and press-fitted, and it is possible to ensure such a joint strength as to sufficiently withstand the clamp torque of the electric wire. Further, by burring the opening of the terminal screw hole, it is possible to form the screw groove having the same width as that of the thick plate.

BRIEF DESCRIPTION OF THE DRAWINGS

FIG. 1(*a*) is a front view showing the construction of a terminal device according to a first embodiment of the present invention, and FIG. 1(*b*) is a side view thereof;

FIG. 2(*a*) is a plan view showing an extended condition of a member in FIG. 1, and FIG. 2(*b*) is a side view;

FIGS. 3(*a*)–3(*d*) are views in explaining a method of assembling the member in FIG. 1, wherein FIG. 3(*a*) is a perspective view showing the state in which engagement projections have not yet fitted into engagement grooves of an elongated metal plate, FIG. 3(*b*) is a view showing the way of press-fitting the joint, FIG. 3(*c*) is a view showing the press-fitted joint, and FIG. 3(*d*) is a sectional view taken along line 3(*d*)–3(*d*) in FIG. 3(*c*);

FIG. 4(*a*) is a plan view of an extended member according to a second embodiment of the present invention, FIG. 4(*b*) is a side view thereof, FIG. 4(*c*) is a perspective view showing the state in which engagement projections have not yet fitted into engagement grooves of an elongated metal plate, FIG. 4(*d*) is a view showing the way of press-fitting the joint, and FIG. 4(*e*) is a view showing the press-fitted joint;

DETAILED DESCRIPTION OF PREFERRED EMBODIMENTS

Figure 5A:
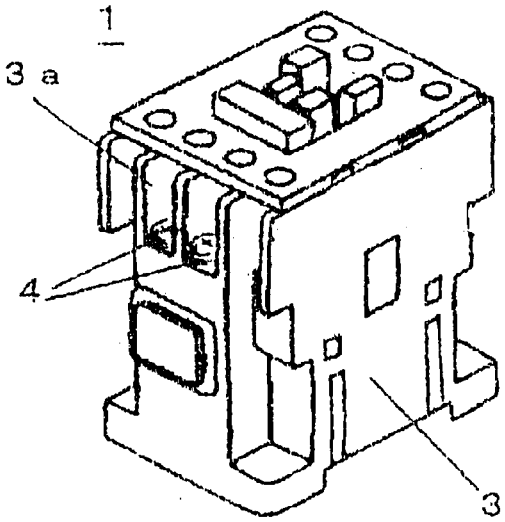
Fig. 5(a) Prior Art
FIGS. 5(*a*) and 5(*b*) are views showing the arrangement of an electric apparatus to which the present invention is applied, wherein FIG. 5(*a*) is an outside view showing an electromagnetic contactor, and FIG. 5(*b*) is an outside view showing a thermal overload relay attached thereto.
Figure 5B:
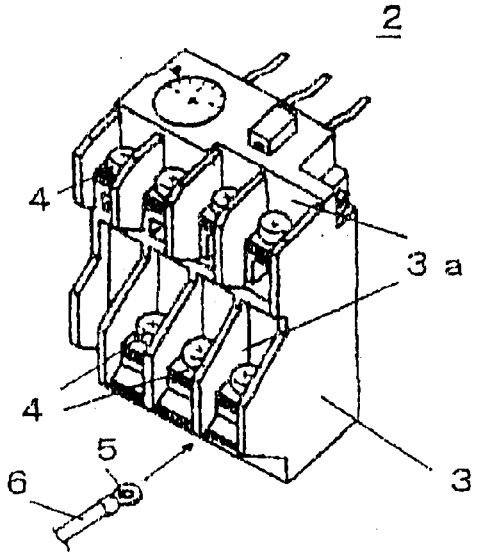
Fig. 5(b) Prior Art
Figure 6A:
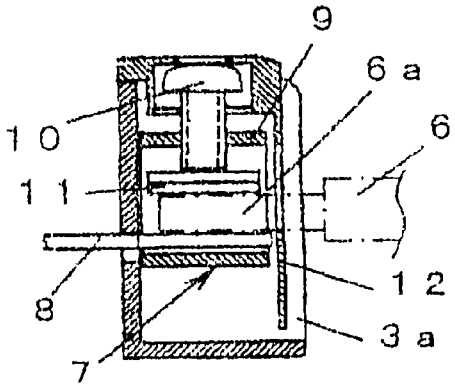
Fig. 6(a) Prior Art
FIG. 6(*a*) is a side sectional view showing the arrangement of a conventional terminal device for use in a terminal of the electric apparatus in FIGS. 5(*a*) and 5(*b*), and FIG. 6(*b*) is a front view thereof.
Figure 6B:
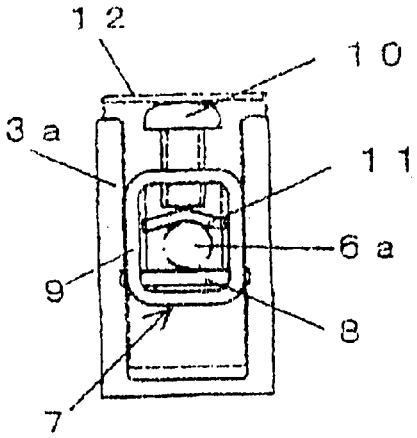
Fig. 6(b) Prior Art

The present invention will now be described with reference to FIGS. 1–3 showing the first embodiment.

FIGS. 1(*a*) and 1(*b*) illustrate an embodiment corresponding to the first, second, and fourth aspects of the present invention. In the embodiment shown in these figures, a member 9 as a component of a terminal device 7 is constructed by bending an elongated metal plate 9-1 in FIG. 2, which is easy to press and bend, in the form of a cylinder, and then fitting engagement projections formed at one end of the metal plate 9-1 into engagement grooves formed at the other end at the corner of the member 9 as described below. The terminal device 7 is constructed by attaching a terminal screw 10 having a washer 11 to the member.

FIGS. 2(*a*) and 2(*b*) show an extended condition of the member 9. In the surface of the elongated metal plate 9-1 as a material for the member 9, a burred screw hole 9*a* is formed at a position corresponding to the center of the upper surface of the member 9 and a burred portion 9*a*-1 projects above from the periphery of the screw hole 9*a*. In parallel with the screw hole 9*a*, press-fitted engagement projections 9*b* are stamped at both sides of one end (left end) of the metal plate 9-1, and engagement grooves 9*c*, into which the press-fitted engagement projections 9*b* are fitted, are notched at both sides of the other end (right end) of the metal plate 9-1. It should be noted that the engagement projections 9*a* are formed to slightly project laterally as shown in FIG. 2(*a*), and the engagement grooves 9*c* are machined to form tapered surfaces 9*c*-1 at the bottom thereof so as to prevent the engagement projections 9*b* from coming off.

The metal plate 9-1, in which the screw hole 9*a*, the engagement projections 9*b* and the engagement grooves 9*c* are formed as described above, is then bent in the form of a square hollow member in a next plating step. On this occasion, the engagement projections 9*b* and the engagement grooves 9*c* formed at both ends of the metal plate 9-1, which intersect at the corner of the member 9 as shown in FIG. 3(*a*), are fitted to one another, and the engagement projections 9*b* are struck in a direction indicated by an arrow to be press-fitted in the engagement grooves 9*c* as shown in FIG. 3(*b*) to thus complete the member 9. It should be noted that FIGS. 3(*c*) and 3(*d*) show the engagement projections 9*b* that have been press-fitted, and as is clear from FIG. 3(*d*), the engagement projections 9*b* are tightly joined to the tapered surfaces 9*c*-1 of the engagement grooves 9*c* so as to prevent the engagement projections 9*b* from coming off. The formation of such tapered surfaces 9*c*-1 surely prevents the engagement projections 9*b* from coming off and improves the contour strength.

It should be noted that the above-described process comprising the step of supplying and cutting the elongated metal plate 9-1, the step of stamping the terminal screw hole 9*a*, the engagement projections 9*b* and the engagement grooves 9*c*, the step of bending the member 9, and the step of press-fitting can be carried out continuously by means of a series of press devices.

Referring next to FIGS. 4(*a*)–4(*b*), a description will be given of the second embodiment corresponding to the third aspect of the present invention. This embodiment is similar to the first embodiment in the construction of the assembled member 9 of the terminal device 7, but is different from the first embodiment in the shapes of the engagement projections 9*b* and the engagement grooves 9*c* formed at both ends of the elongated metal plate 9 and the way of caulking.

Specifically, the press-fitted engagement projections 9*b* are formed parallel at the center of one end (left side) of the elongated metal plate 9-1, and the projections 9*b* are shaped like a dovetail that is broader at its end than at its base. On the other hand, the engagement groove 9*c* formed at the other end (right side) of the metal plate 9-1 is stamped as a window hole broader in width than in length in the surface of the metal plate in such a manner as to correspond to both of the above-mentioned press-fitted engagement projections 9*b*. At the center of the edge of the window hole (at one side closer to the end of the metal plate 9-1), a wedge portion 9*c*-2 is formed toward the inside of the groove, and at the end of the metal plate 9-1, a convex portion 9*d* is formed at a position corresponding to the wedge portion 9*c*-2.

The metal plate 9-1 having the screw hole 9*a*, the engagement projections 9*b* and the engagement grooves 9*c* formed in the above-mentioned manner is bent in the form of a square hollow shape in a next plating step, and the press-fitted engagement projections 9*b* formed at one end of the metal plate 9-1 are fitted into the engagement groove 9*c* as the window hole opened in the surface perpendicular to the engagement projections 9*b* as shown in FIG. 4(*c*), and the end face of the metal plate 9-1 is struck in a direction indicated by an arrow in FIG. 4(*d*). Further, as shown in FIG. 4(*e*), the convex wedge portion 9*c*-2 of the engagement groove 9*c* is deformed and entered between the press-fitted engagement projections 9*b*, so that the engagement projections 9*b* are joined and press-fitted together. In this state, the dovetail-shaped engagement projections 9*b* are engaged with the wedge portion 9*c*-2, so that the engagement projections 9*b* and the engagement groove 9*c* are tightly joined together.

It should be noted that the above-described process comprising the step of supplying and cutting the elongated metal plate 9-1, the step of stamping the terminal screw hole 9*a*, the engagement projections 9*b* and the engagement groove 9*c*, the step of bending the member 9, and the step of press-fitting, is continuously carried out by means of a series of press die devices.

As set forth hereinabove, according to the present invention, the hollow member of the terminal device is constructed by bending the elongated metal plate such that both ends thereof are directly joined together. The elongated metal plate has the burred terminal screw hole, the press-fitted engagement projections formed at one end thereof, and the engagement groove formed at the other end thereof into which the engagement projections are fitted. In the state in which the metal plate is bent in the form of a hollow shape while the terminal screw hole is positioned on top of the hollow member, the engagement projections and the engagement groove are fitted together in the directions perpendicular to each other. This enables the sequence of machining steps to be carried out continuously by means of the simple series of press devices, and reduces the cost to a large extent and improves the dimensional accuracy of the member compared with the conventional casting.

Further, the fitted structure as stated in the second or third aspects makes it possible to ensure such an excellent joint strength as to withstand the clamp torque applied during wiring, and the press-fitted joint structure further improves the reliability.

While the invention has been explained with reference to the specific embodiments of the invention, the explanation is illustrative and the invention is limited only by the appended claims.

What is claimed is:

1. A terminal device of an electric apparatus having a terminal board of a main circuit, comprising:

a hollow member connected to the terminal board of the main circuit of the apparatus and formed of an elongated metal plate including a screw hole, one end having bifurcated engagement projections with first tapered surfaces at portions facing each other, and the other end having engaging grooves with second tapered surfaces at inner surfaces thereof to engage the first tapered surfaces of the engagement projections, said bifurcated engagement projections and engaging grooves being arranged perpendicular to each other when the metal plate is bent in a form of a hollow shape while the screw hole is positioned on top of the hollow member and being directly joined together to connect the one and the other end, and a terminal screw engaged with the screw hole of said hollow member.

2. A terminal device of an electric apparatus according to claim 1, wherein said bifurcated engagement projections are formed to be spaced apart from each other at said one end of the metal plate, and the engagement grooves corresponding to the engagement projections are formed at two lateral sides at the other end of the metal plate.

3. A terminal device of an electric apparatus according to claim 1, wherein the engagement projections and the engagement grooves are joined together to be press-fitted when the engagement projections are fitted in the engagement grooves.

4. A terminal device of an electric apparatus according to claim 1, further comprising an electric wire pressing washer connected with an end of said terminal screw, said terminal screw hole being a burred terminal screw hole.

5. A terminal device of an electric apparatus having a terminal board of a main circuit, comprising:

a hollow member connected to the terminal board of the main circuit of the apparatus and formed of an elongated metal plate including a screw hole, one end having bifurcated engagement projections spaced apart from each other and having a dovetail shape, and the other end having a window hole and a wedge portion projecting into the window hole, said bifurcated engagement projections and window hole being arranged perpendicular to each other when the metal plate is bent in a form of a hollow shape and being directly joined together by disposing the wedge portion in a space between the bifurcated engagement projections in a condition that the bifurcated engagement projections are located in the window hole to thereby connect the one and the other ends, and a terminal screw engaged with the screw hole of said hollow member.

6. A terminal device of an electric apparatus according to claim 5, wherein said window hole has a wedge portion at one side thereof to be held between the bifurcated projections.

7. A terminal device of an electric apparatus according to claim 5, wherein each of the bifurcated projections has a shape such that an end side has a length greater than that of a bottom side, a distance between the bifurcated projections at the bottom sides being longer than that at the end sides.

8. A terminal device of an electric apparatus according to claim 7, wherein the other end has a convex portion projecting outwardly from the metal plate, said convex portion being flattened when the bifurcated engagement projections are fixed in the window hole with the wedge portion.

* * * * *